US005370101A

United States Patent [19]

Hamburg et al.

[11] Patent Number: 5,370,101

[45] Date of Patent: Dec. 6, 1994

[54] FUEL CONTROLLER WITH OXYGEN SENSOR MONITORING AND OFFSET CORRECTION

[75] Inventors: Douglas R. Hamburg, Bloomfield; Nicholas G. Zorka, Clarkston, both of Mich.

[73] Assignee: Ford Motor Company, Dearborn, Mich.

[21] Appl. No.: 131,354

[22] Filed: Oct. 4, 1993

[51] Int. Cl.[5] ..... F02D 41/14

[52] U.S. Cl. ..... 123/688; 123/696

[58] Field of Search ..... 123/688, 691, 692, 695, 123/696

[56] References Cited

U.S. PATENT DOCUMENTS

| | | | |
|---|---|---|---|
| 4,624,232 | 11/1986 | Saito et al. | 123/695 |
| 4,938,194 | 7/1990 | Kato et al. | 123/688 |
| 5,052,361 | 10/1991 | Ono et al. | 123/688 |
| 5,065,728 | 11/1991 | Nakaniwa | 123/688 X |
| 5,237,983 | 8/1993 | Willey et al. | 123/688 |
| 5,247,793 | 9/1993 | Yamada et al. | 123/692 X |

*Primary Examiner*—Willis R. Wolfe

*Attorney, Agent, or Firm*—Allan J. Lippa; Roger L. May

[57] ABSTRACT

A fuel control system operating under closed-loop control senses the oxygen content of the combustion products of an internal combustion engine along with the engine angular velocity and air flow through the intake manifold. The fuel control system supplies an air/fuel modulation signal to modify a fueling value which is calculated as a function of the engine angular velocity and air flow. An oxygen sensor monitoring test is performed periodically to determine the efficacy of the oxygen sensor. The total switching time of the oxygen sensor, comprising the lean-to-rich and rich-to-lean switching times, is determined and checked against a range. If the total switching time is within the range then the difference between the lean-to-rich and rich-to-lean switching times, is determined and checked against a second range. If the difference is within the second range the oxygen sensor is determined to be operating effectively and the test is terminated. If the difference is outside of the second range, a compensation value is generated as a function of the difference in switching times. The monitoring test is performed a predetermined number of times and if at the end of the test the difference in switching times is still outside of the second range, the oxygen sensor is determined to be inoperative.

17 Claims, 7 Drawing Sheets

Lean
Fuel Controller Output
Rich
Time

Lean
Engine Exhaust A/F
Rich
Time

Rich
HEGO Sensor Output
Lean
Time
$t_{r-l}$
$t_{l-r}$

FUEL CONTROLLER WITH OXYGEN SENSOR MONITORING AND OFFSET CORRECTION

FIELD OF THE INVENTION

This invention relates to methods and apparatus for adaptively controlling the delivery of fuel to an internal combustion engine and more particularly, although in its broader aspects not exclusively, to an arrangement for detecting certain characteristics of an oxygen sensor and for altering the delivery of fuel to the engine in response to the detected characteristics.

BACKGROUND OF THE INVENTION

Electronic fuel control systems are increasingly being used in internal combustion engines to precisely meter the amount of fuel required for varying engine requirements. Such systems control the amount of fuel delivered for combustion in response to multiple system inputs including throttle angle and the exhaust gas composition produced by combustion of air and fuel.

Electronic fuel control systems operate primarily to maintain the ratio of air and fuel (A/F) at or near stoichiometry. Electronic fuel control systems operate in a variety of modes depending on engine conditions such as starting, rapid acceleration, sudden deceleration, and idle. A primary mode of operation is closed-loop A/F control.

In closed-loop A/F operation, the oxygen in the exhaust gas is sensed by an oxygen sensor. The electronic fuel control system adjusts the amount of fuel being delivered in response to the output of the oxygen sensor. A sensor output indicating a rich air/fuel mixture (an air/fuel mixture below stoichiometry) will result in a decrease in the amount of fuel being delivered. A sensor output indicating a lean air/fuel mixture (an air/fuel mixture above stoichiometry) will result in an increase in the amount of fuel being delivered.

As the oxygen sensor ages, its output tends to deteriorate. For example, the sensor may take longer to switch from a lean indication to a rich indication, and vice-versa. If such a deterioration is not detected and compensated for, the fuel controller will deliver either too much or too little fuel to the engine, and consequently tailpipe emissions will increase. Accordingly, there is a need for a strategy by which the efficacy of an oxygen sensor may be accurately determined. There is also a need for accounting for a deterioration in the output of the oxygen sensor when determining the amount of fuel to be delivered to the engine.

SUMMARY OF THE INVENTION

In accordance with a principal feature of the invention, a bias in an oxygen sensor resulting from among other things, deterioration of the sensor, is detected and the amount of fuel delivered to the engine is altered in response to the detected bias in the oxygen sensor. As contemplated by the invention, a fuel controller, for calculating an air/fuel composition for ignition in an internal combustion engine, calculates a quantity of fuel for the air/fuel composition in response to the oxygen content in the ignited air/fuel ratio as detected by the oxygen sensor. The output of the oxygen sensor is checked by the fuel controller for a bias, and the calculated quantity of fuel is altered in response to the detected bias.

In accordance with the invention, the bias is detected by first determining the total switching time of the oxygen sensor which comprises the sum of a first switching time for switching from a lean air/fuel composition to a rich air/fuel composition and a second switching time for switching from a rich air/fuel composition to a lean air/fuel composition. The total switching time is checked to determine if it is within a predetermined range and if so, then the difference between the first and second switching times is determined. If the total switching time is outside of the predetermined range then an oxygen sensor inoperative condition is set. The difference in switching times is then checked against a second predetermined range and if it is outside of the range then the oxygen sensor inoperative condition is set. If the difference is within the range then the calculated quantity of fuel is altered by an amount consistent with the detected bias.

The present invention, particularly in certain preferred embodiments, offers the advantage of adaptively compensating for changes in the operational characteristics of the oxygen sensor which may occur by deterioration of the oxygen sensor by detecting certain characteristics of the sensor and altering the amount of fuel delivered to the engine in a manner which compensates for the deterioration. Consequently, increased exhaust emissions resulting from a deteriorating oxygen sensor are minimized.

These and other features and advantages of the present invention may be better understood by considering the following detailed description of a preferred embodiment of the invention. In the course of this description, reference will frequently be made to the attached drawings.

DETAILED DESCRIPTION

Figure 1:
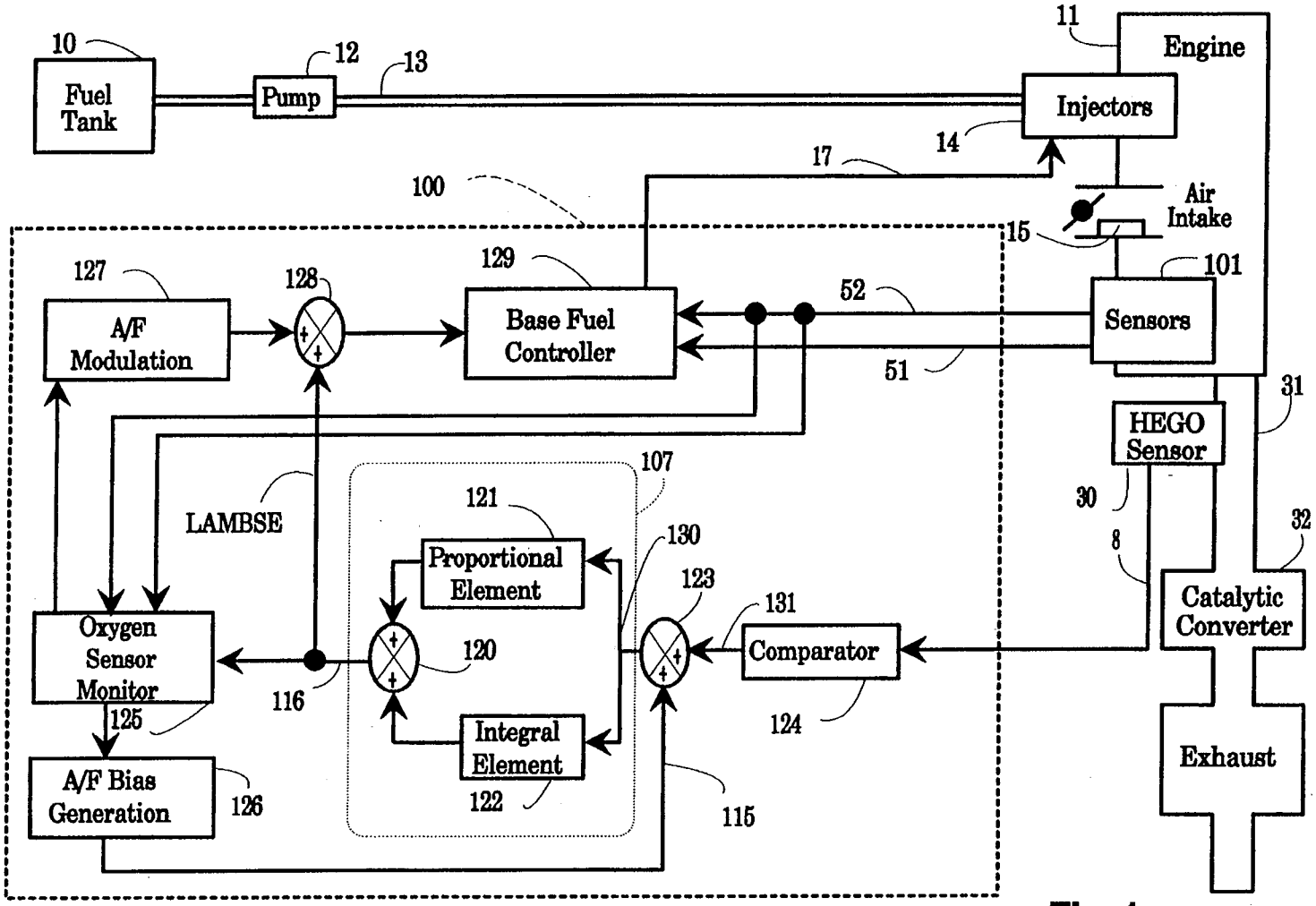
FIG. 1 is a schematic diagram of an internal combustion engine and an electronic fuel control system which embodies the invention.

FIG. 1 of the drawings shows a system which embodies the principles of the invention. A fuel pump 12 pumps fuel from a fuel tank 10 through a fuel line 13 to a set of fuel injectors 14 which inject fuel into an internal combustion engine 11. The fuel injectors 14 are of conventional design and are positioned to deliver fuel to their associated cylinders in precise quantities. The fuel tank 10 advantageously contains liquid fuels such as gasoline, methanol, or a combination of fuel types.

A heated exhaust gas oxygen (HEGO) sensor 30, positioned in the exhaust system 31 of the engine 11, detects the oxygen content of the exhaust gas generated by the engine 11, and transmits a representative signal 8 to an Electronic Engine Controller (EEC) 100. The preferred embodiment utilizes a HEGO type oxygen sensor. However, other types of oxygen sensors such as an unheated exhaust gas oxygen sensor (EGO) or a universal exhaust gas oxygen (UEGO) sensor may be used. A catalytic converter 32 operates to chemically alter certain components of the exhaust gas in order to reduce tailpipe emissions. Still other sensors, indicated generally at 101, provide additional information about engine operation to the EEC 100, such as crankshaft position, angular velocity, throttle position, etc. The information from these sensors is used by the EEC 100 to control engine operation.

A mass air flow detector 15 positioned at the air intake of engine 11 detects the amount of air being supplied to cylinders for combustion. The EEC 100 implements the functions shown in block diagram form within the dashed line 100 in FIG. 1. The EEC functions 100 are preferably implemented by one or more microcontrollers, each being comprised of one or more integrated circuits providing a processor, a read-only memory (ROM) which stores configuration data and the programs executed by the processor, peripheral data handling circuits, and a random access read/write scratchpad memory for storing dynamically changing data. These microcontrollers typically include built-in analog-to-digital conversion capabilities useful for translating analog signals from sensors and the like into digitally expressed values, as well as timer/counters for generating timed interrupts.

A microcontroller within the EEC 100 further implements a proportional plus integral (P-I) controller seen at 107 which is comprised of a proportional element 121, an integral element 122, and an adder 120 to sum the outputs of the proportional and integral elements. A comparator 124 receives the HEGO signal 8 and generates a binary HEGO signal 131 having the value +1 when the HEGO sensor indicates an air-fuel ratio rich of stoichiometry, and a value of −1 when the air-fuel ratio indicated by the HEGO sensor is lean of stoichiometry. The P-I controller responds to the binary HEGO signal 131, is modified at adder 123 and is transmitted to the P-I controller 107 via signal line 130. The P-I controller responds to the binary HEGO signal 131 to control the amount of fuel delivered by the injectors 14 by supplying an air-fuel feedback signal 116 called LAMBSE, which represents a desired change in relative A/F, to a further control module 129 which calculates a fuel delivery value, and supplies the resulting fuel delivery value signal 17 to the injectors 14.

The EEC 100 further implements an air/fuel modulation function, seen at 127, an oxygen sensor monitoring function seen at 125, and an (A/F) bias generation function seen at 126. The A/F modulation function receives control signals from the oxygen sensor 125 via control line 140 and modulates LAMBSE via an adder seen at 128. The oxygen sensor monitor 125 operates generally to periodically monitor certain operating characteristics of the HEGO sensor 30 via the A/F feedback signal LAMBSE, and sensor signals 51 and 52. The A/F bias generation block 126 generates a compensation term to modify at 123 the binary HEGO signal 131 in response to the operational characteristics detected by the oxygen sensor monitor 125.

The base fuel controller 129 also receives data concerning engine angular velocity (rpm) and normalized mass air flow rate (load) via sensor signals 51 and 52 from the engine sensors 101. These signals in combination indicate an estimated air charge value into each cylinder of the engine (cylinder air charge). The preferred embodiment utilizes engine angular velocity and mass air flow rate to determine an estimate of the cylinder air charge value into the engine. Alternatively, other indicators, such as a combination of manifold pressure and engine angular velocity may also be used to determine an estimate of the cylinder air charge value into the engine.

Figures 2A, 2B, 2C:
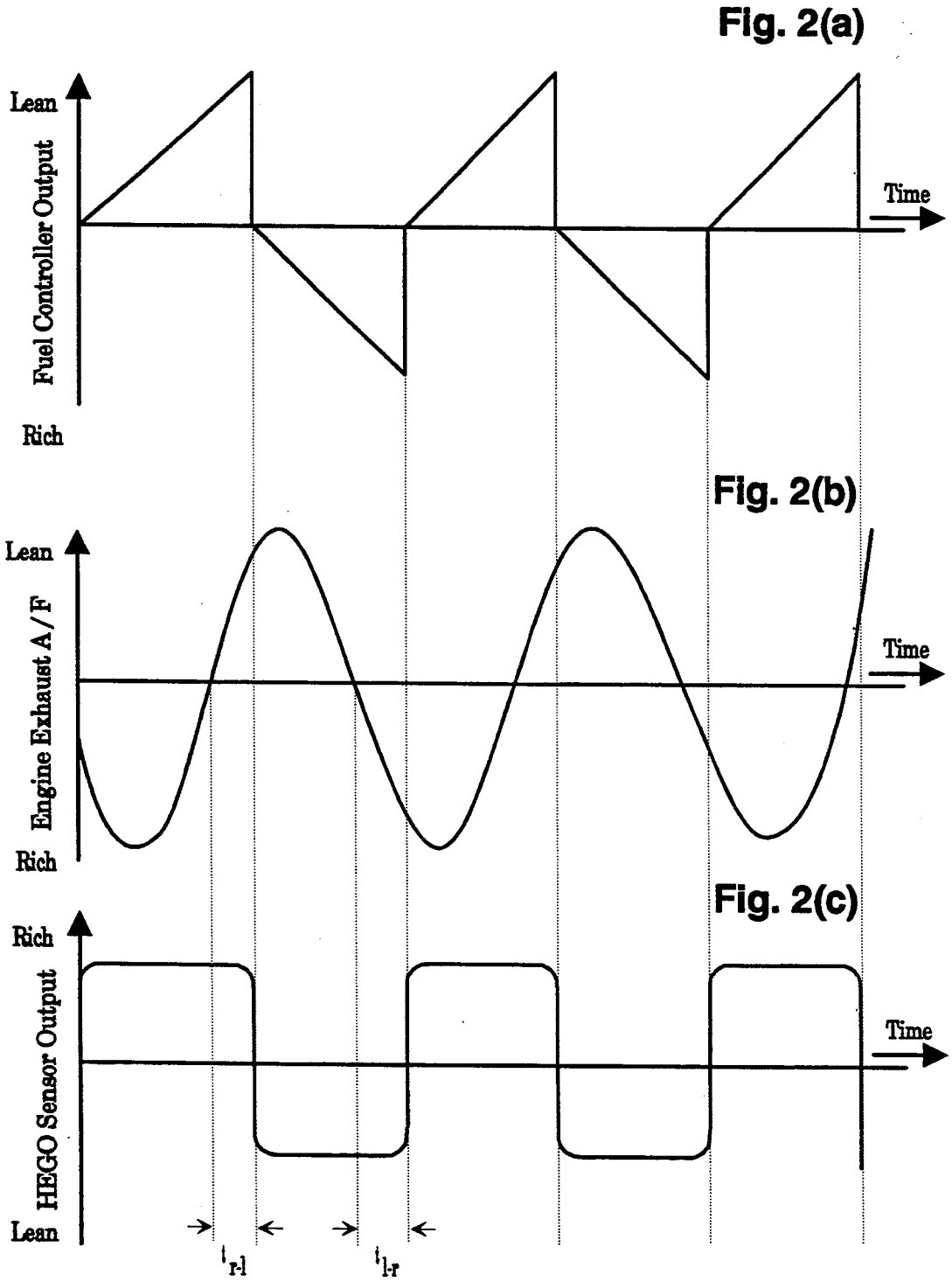
FIGS. 2(*a–c*) are graphs showing, respectively, the output of an air/fuel control system, the corresponding A/F in the engine exhaust and the output of an oxygen sensor in response to the exhaust A/F.

The P-I controller 107 determines, according to the binary HEGO signal 131, whether the fuel delivery rate at the injectors 14 is to be increased or decreased, depending upon whether the HEGO sensor 30 indicates an oxygen level above or below stoichiometry, respectively. FIG. 2(*a*) of the drawings shows typical waveshapes created by an air/fuel control system using the P-I controller 107. Such a controller may take the form described by D. R. Hamburg and M. A. Schulman in SAE Paper 800826. The controller output signal, LAMBSE, is derived from the sum of an integral and a proportional operation on the HEGO sensor output signal, thus forming the sawtooth-shaped waveform versus time curve labeled "Fuel Controller Output" in FIG. 2 (*a*). The variable $t_{total}$ shows the time required for the controller output signal, LAMBSE, to complete one cycle. This time may also be expressed in terms of the inverse frequency of the waveform. Herein termed the limit cycle frequency, this is the frequency, with which the fuel command signal varies.

The curve labeled "Engine Exhaust A/F" in FIG. 2(*b*) illustrates the variation in the oxygen content of the exhaust gas versus time at the sensor. Both the fuel controller output curve and the "Exhaust A/F" curve in FIG. 2(*b*) are plotted such that increasing A/F (decreasing richness) is represented by positive-going increases on the graph. Note that the exhaust A/F curve is displaced in time with respect to the fuel controller output because of the time delay through the engine.

The curve labeled "HEGO Sensor Output" in FIG. 2(*c*), illustrates the HEGO sensor output versus time in response to the engine A/F. This curve, which is plotted such that decreasing A/F is represented by positive-going increases, shows the switching time delays associated with the HEGO sensor. Specifically, $t_{r-l}$ is the time required for the oxygen sensor to switch from a maximum rich indication to a maximum lean indication, and $t_{l-r}$ is the time required for the sensor to switch from a maximum lean indication to a maximum rich indication. The total switching time ($t_{total}$) of the sensor is defined as the sum of $t_{r-l}$ and $t_{l-r}$.

As will be explained below, the preferred embodiment of the present invention advantageously screens out HEGO sensors which have unacceptably long switching times by measuring the actual operating limit-cycle frequency of the engine. If the total switching time of the HEGO sensor is acceptable, then the sensor is further checked to determine if the sensor has an acceptable difference between the lean-to-rich and rich-to-lean switching times by externally modulating the A/F at the measured limit-cycle frequency. Modulating the A/F at the measured limit-cycle frequency advantageously provides a higher sensitivity to defective oxygen sensors than if the modulation frequency were held constant, independent of engine operation conditions.

Figure 3A:
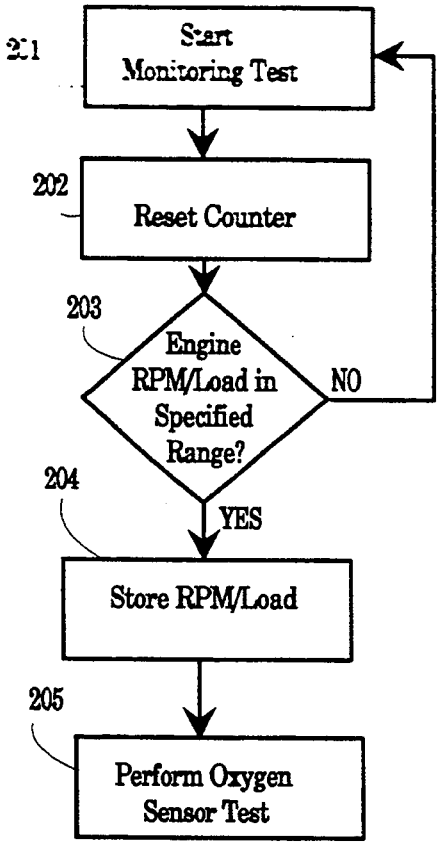
FIGS. 3(*a–c*) are flowcharts showing the operation of a preferred embodiment of the invention.
Figure 3B:
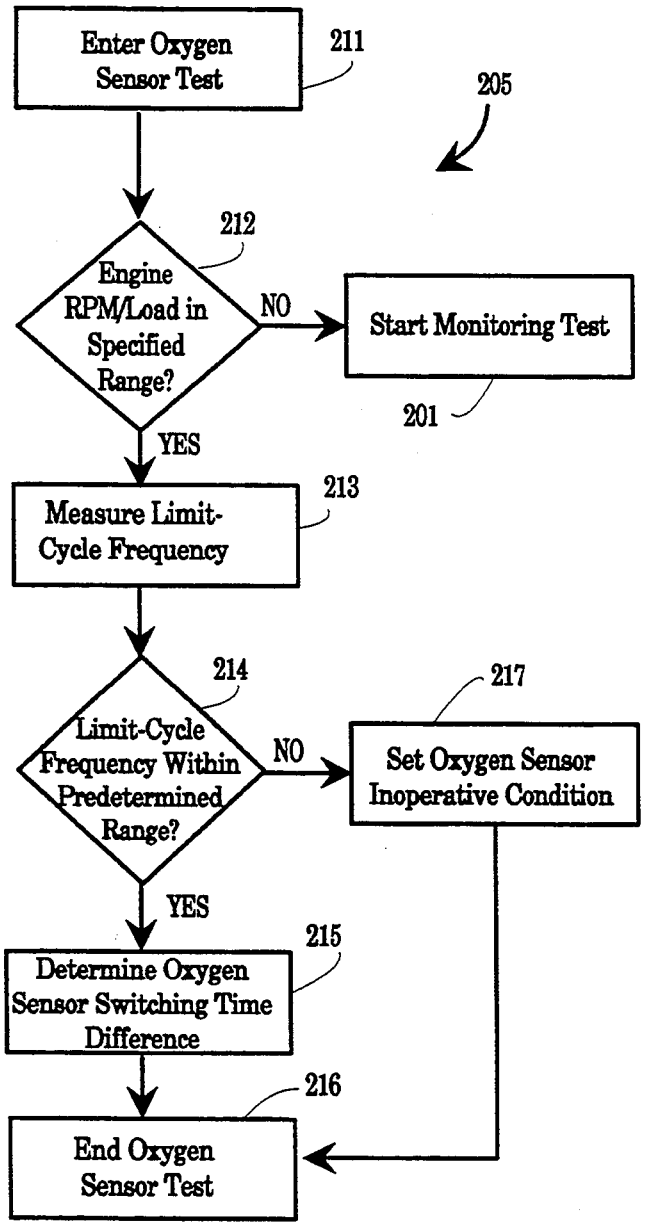
Figure 3C:
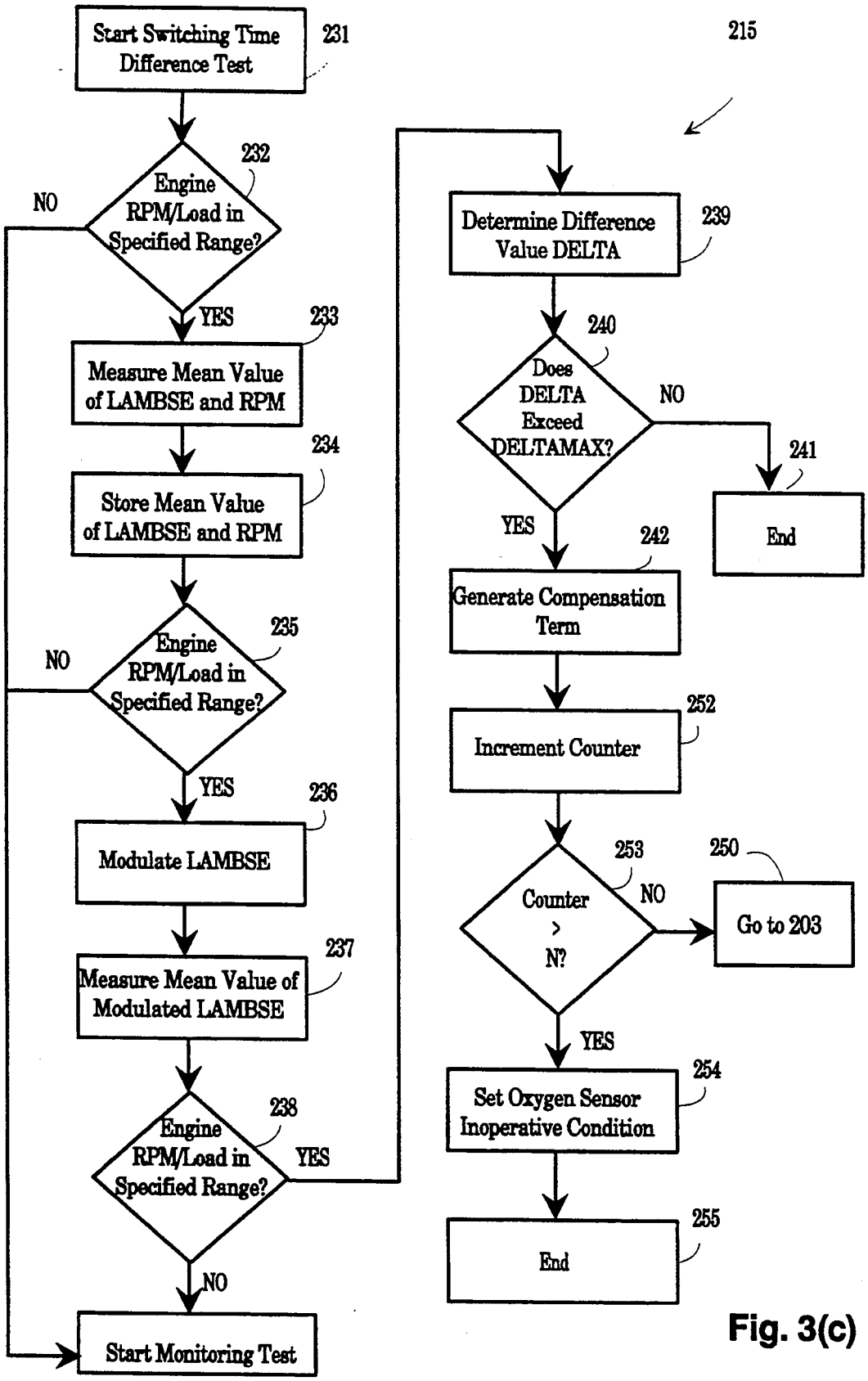
Figure 4A:
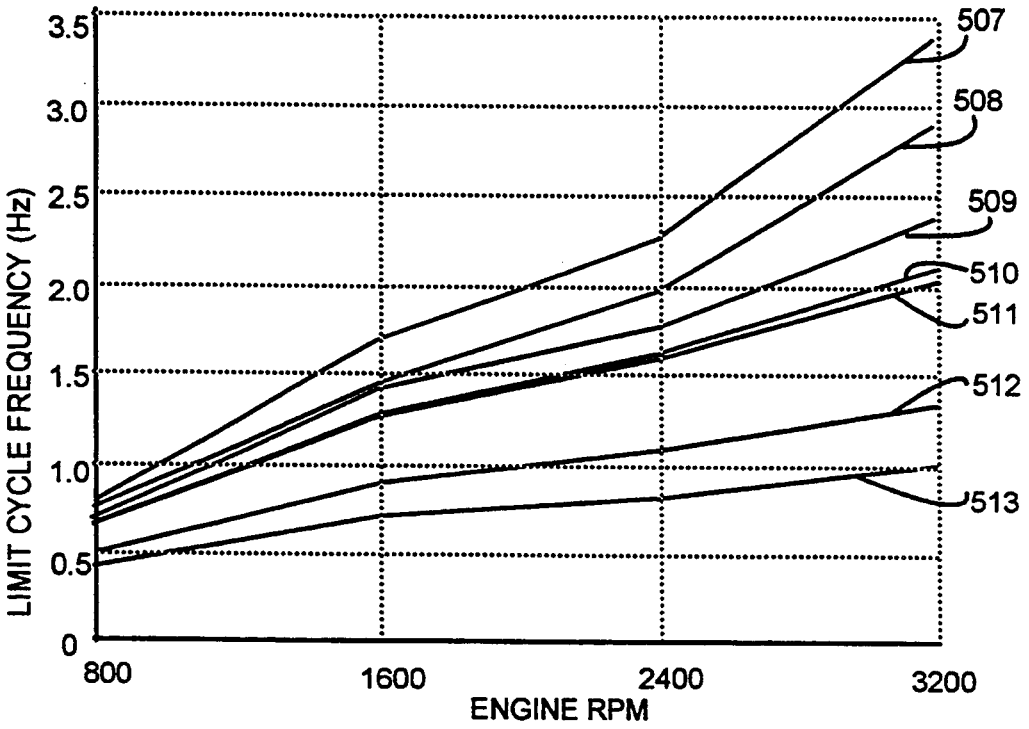
FIGS. 4(*a–d*) are graphs showing the variation of various engine control system parameters as a function of engine rpm.
Figure 4B:
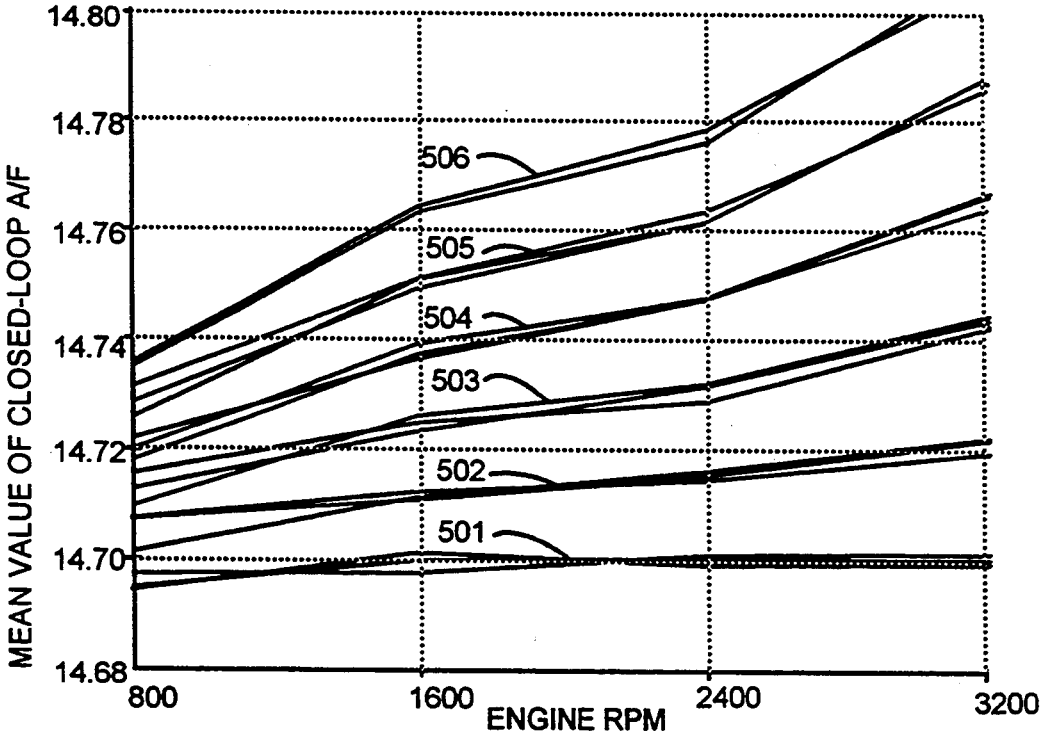
Figure 4C:
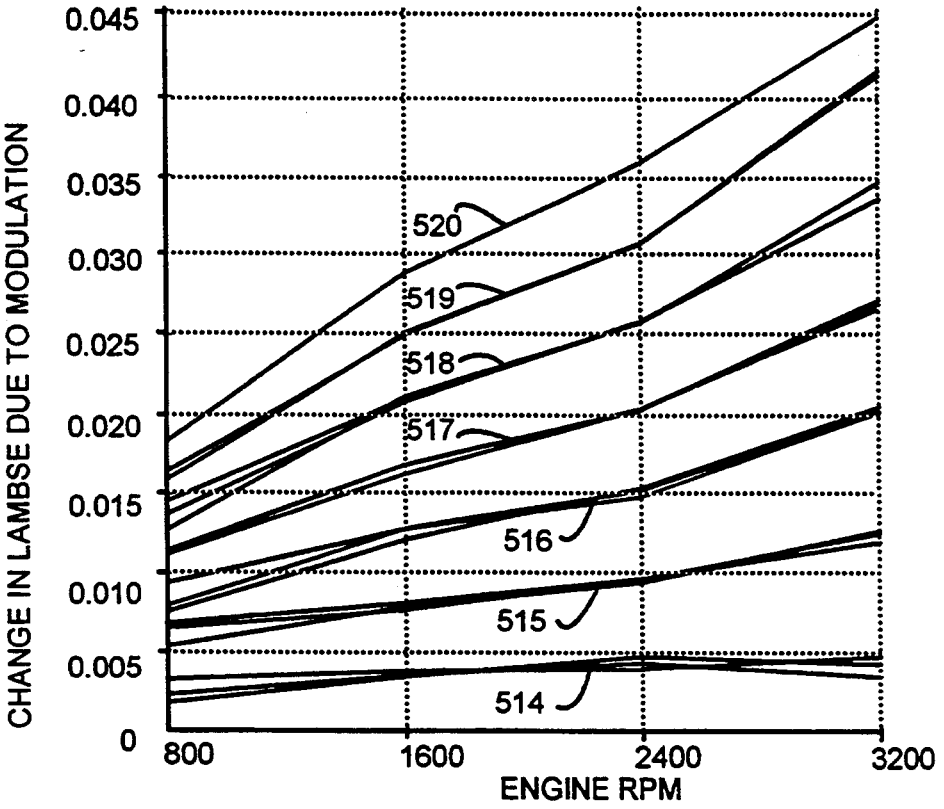
Figure 4D:
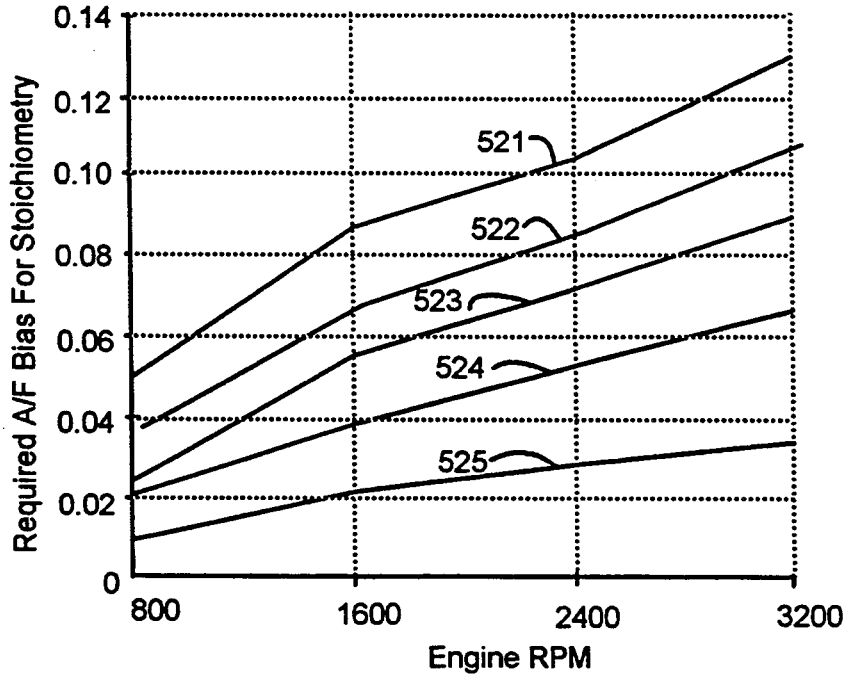

FIG. 3(*a*) is a flowchart showing the general operation of the preferred embodiment of the present invention. At 201, a monitoring test is initiated at least once each time the engine is started when the EEC 100 is operating the warmed-up engine under closed-loop A/F control and the engine rpm and load are in a certain range. The preferred embodiment of the present invention advantageously determines the engine load from the normalized mass flow rate of air into the engine; however, other means may also be used. At 202, a loop counter is initialized. This loop counter controls the number of times the steps of the complete monitoring/correction process are performed. The complete monitoring/correction process is advantageously performed four times in order to generate an accurate indication of the state of the HEGO sensor.

The engine rpm and load are checked and stored at 203 and 204 to ensure they are within the predetermined range required for the monitoring test. As can be seen from the tests performed at 212, 232, 235 and 238 in FIGS. 3(*a–c*), these parameters are checked periodically throughout the monitoring test to ensure the accuracy of the test results. The parameters detected are stored in a memory contained within the controller 100. If either of the parameters exceed the specified range and the test is aborted, the parameters are periodically checked by the EEC 100 and the test is restarted when the parameters are each within the respective specified ranges.

At 205, an oxygen sensor test is performed. As mentioned above, this test advantageously performs a two-step test to determine the efficacy of the HEGO sensor. FIG. 3(*b*) shows the steps taken in the oxygen sensor test depicted at 205 in FIG. 3(*a*). First, as mentioned before, the engine rpm and load are checked to ensure they are within the same range as when they were measured at 203. If not, then the oxygen sensor test is aborted and the monitoring test is restarted. If the engine rpm and load are within the specified range, then the limit-cycle frequency is measured at 213 to determine if the total switching time of the HEGO sensor has increased. To do this, the measured limit-cycle frequency is checked at 214 to determine if it is within a specific predetermined limit-cycle frequency range, which is formed by choosing a threshold value. This threshold value is preferably a function of engine rpm, and is chosen to be a specific fraction of the limit-cycle frequency which would exist if the HEGO sensor were perfect; i.e., had zero switching time. In the preferred embodiment, the threshold value is chosen to be 75% of the limit-cycle frequency which would exist if the HEGO sensor were perfect. If the measured limit-cycle frequency is below the threshold value, it will be so because the total switching time of the HEGO sensor has increased, causing the limit-cycle frequency to decrease. In such a case, the HEGO sensor is determined to be defective and an oxygen sensor defective condition within the EEC 100 is set, which causes an on-board diagnostic malfunction indicator light to be activated. The oxygen sensor test is then terminated.

FIG. 4(*a*) illustrates the effect which the HEGO sensor total switching time has on the limit-cycle frequency,. This figure, which shows values for limit-cycle frequency in hertz plotted for various values of engine rpm for seven different values of HEGO sensor total switching times (given in the table below in milliseconds (ms)), was derived from a computer model of a typical engine. Curves designated by the reference numbers 507–513 correspond to the following HEGO sensor total switching times:

| Curve Reference Number | HEGO Sensor Total Switching Time (ms) |
|---|---|
| 507 | 60 |
| 508 | 100 |
| 509 | 140 |
| 510 | 180 |
| 511 | 200 |
| 512 | 400 |
| 513 | 600 |

As can be seen from FIG. 4(*a*), the limit-cycle frequency, for a nearly perfect sensor with a typical total switching time of 60 ms is 1.7 Hertz at 1600 rpm. If the HEGO sensor were to deteriorate so that its total switching time increased to 180 ms, the limit-cycle frequency at 1600 rpm would drop to 1.25 Hertz. Such a limit-cycle frequency, which is approximately 25% lower than that for a perfect HEGO sensor, would be outside of the predetermined range in the test shown at 214 in FIG. 3(*b*). Such low limit-cycle frequencies are undesirable because they result in higher exhaust emissions due to the decreased transient A/F response time and increased limit-cycle A/F amplitudes. Accordingly, the preferred embodiment of the present invention would determine such a sensor to be defective and would set the oxygen sensor inoperative condition at 217 in FIG. 3(*b*).

If the measured limit-cycle frequency is within the predetermined range, i.e. greater than the threshold value of 75% of the limit cycle frequency of a perfect sensor, then the sensor is further checked by determining the difference between the rich-to-lean and the lean-to-rich switching times as shown at 215. The following discussion demonstrates the necessity and benefit of this second step in determining the efficacy of the oxygen sensor.

As explained earlier, the total switching time of an oxygen sensor, $t_{total}$, comprises the sum of the lean-to-rich switching time, $t_{l-r}$ and the rich-to-lean switching time, $t_{r-l}$. If $t_{l-r}$ and $t_{r-l}$ are unequal, there will be a resultant shift or bias in the closed-loop A/F of the engine. This phenomena is illustrated in FIG. 4(*b*) which shows the mean value of the closed-loop A/F plotted against engine rpm for HEGO sensors having the following differences between the rich-to-lean and lean-to-rich switching times in milliseconds (ms):

| Curve Reference Number | Difference in Switching Times (Δ) ms $\Delta = t_{r-1} - t_{1-r}$ (ms) | Actual Switching Times (ms) |
|---|---|---|
| 506 | 100 | $t_{1-r} = 30$, $t_{r-1} = 130$ |
| | | $t_{1-r} = 50$, $t_{r-1} = 150$ |
| 505 | 80 | $t_{1-r} = 30$, $t_{r-1} = 110$ |
| | | $t_{1-r} = 50$, $t_{r-1} = 130$ |
| | | $t_{1-r} = 70$, $t_{r-1} = 150$ |
| 504 | 60 | $t_{1-r} = 30$, $t_{r-1} = 90$ |
| | | $t_{1-r} = 50$, $t_{r-1} = 110$ |
| | | $t_{1-r} = 70$, $t_{r-1} = 130$ |
| 503 | 40 | $t_{1-r} = 30$, $t_{r-1} = 70$ |
| | | $t_{1-r} = 50$, $t_{r-1} = 90$ |
| | | $t_{1-r} = 70$, $t_{r-1} = 110$ |
| 502 | 20 | $t_{1-r} = 30$, $t_{r-1} = 50$ |
| | | $t_{1-r} = 50$, $t_{r-1} = 70$ |
| | | $t_{1-r} = 70$, $t_{r-1} = 90$ |
| 501 | 0 | $t_{1-r} = 30$, $t_{r-1} = 30$ |
| | | $t_{1-r} = 50$, $t_{r-1} = 50$ |
| | | $t_{1-r} = 70$, $t_{r-1} = 70$ |

As shown in FIG. 4(*b*), if the HEGO sensor deteriorates so that the difference between $t_{r-l}$ and $t_{l-r}$ increases from zero ms at curve 501 to 20 ms at curve 502, the resultant shift or bias in the mean value of the closed-loop A-F will be 0.02 A/F (14.72 − 14.70) at 3200 rpm. Since the window over which a typical catalytic converter provides high conversion efficiency is only about 0.03 A/F wide, a difference of 20 ms between $t_{r-l}$ and $t_{l-r}$ can be considered the maximum allowable deterioration in the HEGO sensor. Curve 502 of FIG. 4(*b*) shows that a sensor having a difference of 20 ms will produce an A/F shift or bias of less than 0.02 at lower rpm values. However, since the engine rpm will vary widely when operating over the Federal Test Procedure (FTP) testing cycle, the highest expected value (3200 rpm in FIG. 4(*b*)) is used to specify the allowable difference between $t_{r-l}$ and $t_{l-r}$.

The preferred embodiment of the present invention advantageously detects sensors having a bias corresponding to a difference between the rich-to-lean and lean-to-rich switching times on the order of only 20 ms in order to provide an accurate indication of the efficacy of the HEGO sensor. FIG. 3(*c*) shows the steps taken in determining the difference in the switching times. As discussed before, the engine rpm and load are checked at 232, 235 and 238 to ensure the engine is operating within the same range as when the monitoring test was initiated. The mean value of the air-fuel feedback signal LAMBSE is measured at 233 over a predetermined time interval. The measured value is then stored at 234 along with the actual engine operating rpm in the memory of the EEC 100.

The air-fuel feedback signal LAMBSE is then modulated, at 236, at the limit-cycle frequency measured at 213, and at an amplitude chosen preferably to provide a peak-to-peak fluctuation of approximately 10% in the commanded air-fuel ratio.

After the modulation is applied, the mean value of the new LAMBSE will be measured at 237, and the difference between the stored (original) value of LAMBSE and the modulated value of LAMBSE will be computed. This LAMBSE difference will be used at 239 along with the stored engine rpm to determine the difference (DELTA) between the rich-to-lean and the lean-to-rich switching times of the HEGO sensor. (The method for determining DELTA from the LAMBSE difference and engine rpm will be explained later.) The value DELTA will then be compared to a predetermined value DELTAMAX at 240. (As noted earlier, 20 ms is considered to be the maximum allowable difference between the rich-to-lean and the lean-to-rich switching times of a HEGO sensor in order to remain in the window of a catalyst as the sensor deteriorates; thus, a typical value for DELTAMAX is 20 ms.)

If DELTA is greater than DELTAMAX at 240, then as will be explained below, a compensation term for altering the fuel delivery value is generated at 242 and stored in a non-volatile memory, of the EEC 100. The loop counter will then be incremented at 252 and checked at 253. If the loop which was begun at 201 in FIG. 3(*a*) has been executed N number of times, the HEGO sensor is deemed to be inoperative. The sensor inoperative condition is thus set at 254 and the test is ended at 255. The monitoring test shown generally in FIG. 3(*a*) and the more detailed steps shown in FIGS. 3(*b*) and 3(*c*) are advantageously performed several times (N=4) in order to accurately compensate for a deteriorated HEGO sensor. The number of monitoring test loops is limited to 4 in order to avoid the generation of a compensation value which attempts to compensate for a sensor which either has failed completely or has failed to an extent to which the compensation value cannot be used to accurately correct the offset A/F error.

If DELTA is less than DELTAMAX at 240, then the HEGO sensor is deemed to be operative and to have operating characteristics such that further modification of the compensation or A/F biasing term is not needed. Accordingly, at 241 the monitoring test begun in FIG. 3(*a*) is ended.

The determination of DELTA at 239 is based on the fact that the difference between the unmodulated value of LAMBSE (measured at 233) and the modulated value of LAMBSE (measured at 237) is dependent on DELTA and engine rpm. A function which relates the LAMBSE difference to DELTA and engine rpm is stored in the EEC 100, and is derived from data such as contained in the curves shown in FIG. 4(*c*) which were derived from a computer model of a typical engine. FIG. 4(*c*) shows the change in LAMBSE (from no modulation to modulation) plotted as a function of engine rpm for different combinations of rich-to-lean and lean-to-rich switching times. The switching times, along with the rich-to-lean and lean-to-rich differences (DELTA), are shown in the table below with the curve reference number given in the left hand column:

| Curve Reference Number | Difference in Switching Times (Δ) ms $\Delta = t_{r-1} - t_{l-r}$ | Actual Switching Times (ms) |
|---|---|---|
| 520 | 120 | $t_{l-r} = 30$, $t_{r-1} = 150$ |
| 519 | 100 | $t_{l-r} = 30$, $t_{r-1} = 130$ |
| | | $t_{l-r} = 50$, $t_{r-1} = 150$ |
| 518 | 80 | $t_{l-r} = 30$, $t_{r-1} = 110$ |
| | | $t_{l-r} = 50$, $t_{r-1} = 130$ |
| | | $t_{l-r} = 70$, $t_{r-1} = 150$ |
| 517 | 60 | $t_{l-r} = 30$, $t_{r-1} = 90$ |
| | | $t_{l-r} = 50$, $t_{r-1} = 110$ |
| | | $t_{l-r} = 70$, $t_{r-1} = 130$ |
| 516 | 40 | $t_{l-r} = 30$, $t_{r-1} = 70$ |
| | | $t_{l-r} = 50$, $t_{r-1} = 90$ |
| | | $t_{l-r} = 70$, $t_{r-1} = 110$ |
| 515 | 20 | $t_{l-r} = 30$, $t_{r-1} = 50$ |
| | | $t_{l-r} = 50$, $t_{r-1} = 70$ |
| | | $t_{l-r} = 70$, $t_{r-1} = 90$ |
| 514 | 0 | $t_{l-r} = 30$, $t_{r-1} = 30$ |
| | | $t_{l-r} = 50$, $t_{r-1} = 50$ |
| | | $t_{l-r} = 70$, $t_{r-1} = 70$ |

The determination of DELTA is obtained from data such as shown in FIG. 4(*c*) by simply finding the switching time difference which corresponds to the measured change in LAMBSE (caused by modulation) and the engine rpm. By way of example, suppose that the measured change in LAMBSE due to modulation was 0.0125, and the engine rpm was 1600 rpm. If these values are applied to FIG. 4(*c*), the value of 40 ms would be obtained (from curve 516). The preferred embodiment of the present invention will determine such a change at 1600 rpm to be outside of the corresponding DELTAMAX value, and consequently will set the oxygen sensor inoperative condition.

In addition to monitoring the HEGO sensor to determine its efficacy, the preferred embodiment of the present invention also utilizes the results of the monitoring procedure to alter the fuel flow to the engine in a manner which advantageously corrects for inaccuracies in the flow resulting from a deteriorated oxygen sensor. The difference value DELTA is utilized by the EEC 100 to generate a compensation term which is a function of A/F bias versus rpm to be used in compensating, or biasing, for the error in the fuel flow resulting from a deteriorated HEGO sensor, i.e., the closed-loop A/F offset error. The preferred embodiment advantageously utilizes data stored in the memory of the EEC 100 to generate such a term.

FIG. 4(*d*) graphically shows data of the type used to generate the compensation term. In FIG. 4(*d*) the required A/F bias, the bias necessary to make the A/F equal stoichiometry, is plotted as a function of engine rpm for various values of DELTA. Curves 521, 522, 523, 524 and 525 represent, respectively the following values of DELTA: 100 ms, 80 ms, 60 ms, 40 ms, and 20 ms. The EEC 100 employs such data to determine the compensation term at a given DELTA and engine rpm.

The operation of the compensation term can be seen in FIG. 1. The compensation term generated in the A/F bias generation block at 126 is added at 123 to the output of the comparator 124. The proportional-integral (P-I) feedback controller 107 operates by driving the engine A/F to a value which will cause the input 130 to the controller to have a mean value equal to zero. If the A/F bias, or compensation term, applied at 123 via signal line 115 is set to zero, the input to the P-I controller is supplied entirely from the output of comparator 124. With a perfect HEGO sensor, when EEC 100 is operating in a normal limit-cycle oscillation mode, the comparator output 131 will be +1, 50% of the time and will be −1, 50% of the time (a 50% duty cycle). Such a duty cycle will correspond to a mean A/F equal to stoichiometry. When the bias, or compensation, term is added at 123 to the P-I controller input, the controller will respond by producing integration rates which are unequal for rich-to-lean and lean-to-rich swings. This, in turn, will cause the engine A/F to shift in order to maintain the input to the controller at a mean value of zero. In order for this to occur, the duty cycle of the comparator output signal will change in response to changes in the bias. Accordingly, in a HEGO sensor in which the rich-to-lean and lean-to-rich switching times are unequal, such that the duty cycle of the comparator output is not 50% when the A/F equals stoichiometry, and the input to the sensor (the fuel delivery value) is oscillating at a 50% duty cycle, the preferred embodiment will adjust the bias to make the mean A/F equal to stoichiometry.

The steps shown in FIGS. 3(*a–c*) are preferably performed each time the engine is started. Accordingly, a situation may arise where the oxygen sensor monitoring steps are performed with an A/F bias value being applied which was determined from a prior monitoring-/correcting cycle. In such an instance, if the monitoring steps detect an inoperative sensor, the A/F bias generated from the monitoring steps is no longer applied. Instead, the existing A/F bias value is removed and the monitoring and correcting steps are performed again, and the resulting new A/F bias value is applied.

Figure 5:
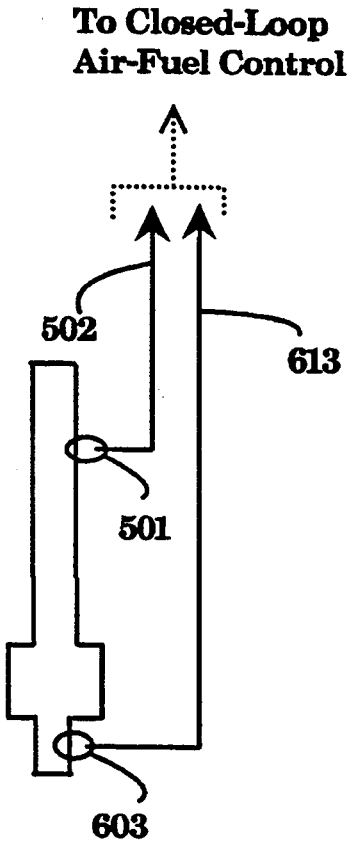
FIGS. 5(*a–b*) are diagrams of an exhaust system capable of being used in a preferred embodiment of the invention.
Figure 5:
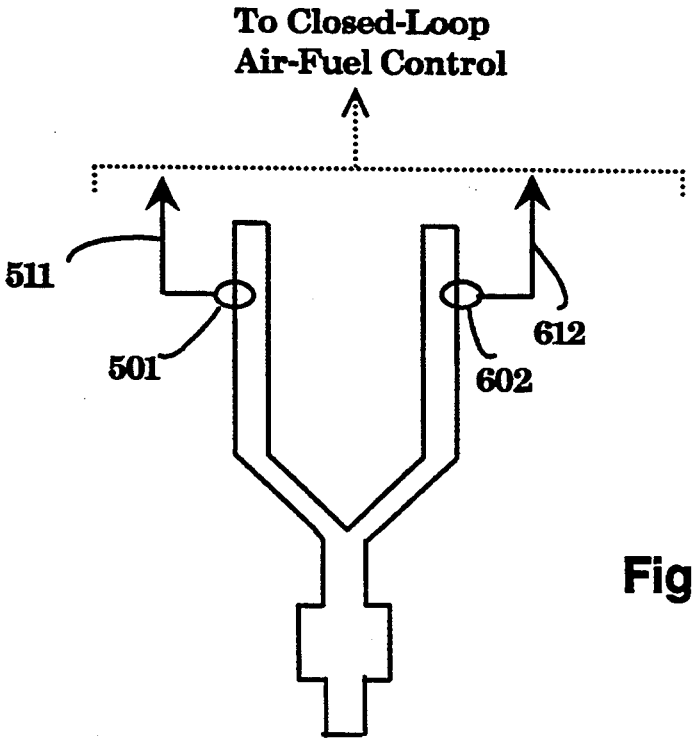

FIG. 5(*a*) shows an alternative embodiment of the invention which utilizes a post-catalyst feedback oxygen sensor 603 which transmits a post-catalyst feedback signal indicative of the catalyzed combustion products via signal line 613 to he EEC 100 to form a feedback loop. In such an embodiment, the post feedback loop is opened and the signal transmitted via line 613 is set to a single value, or reset to zero during the tests shown in FIGS. 3(*a–c*) so as to prevent the post-catalyst feedback signal from "masking" any offset in the air-fuel ratio caused by a pre-catalyst oxygen sensor such as that shown at 30 in FIG. 1.

In the embodiment shown in FIG. 5(*a*), the criterion for rejecting the pre-catalyst sensor based on the difference between the original measured value of LAMBSE and the modulated value of LAMBSE may be relaxed in a manner consistent with the dynamic correction range of the post-catalyst feedback loop. Thus, if the steps shown in FIGS. 3(*a–c*) were applied in an embodiment as shown in FIG. 5(*a*), then the DELTAMAX value, could be increased from the 20 ms value noted earlier to a higher value such as 40 ms.

FIG. 5(*b*) shows multiple pre-catalyst feedback oxygen sensors 501 and 602 which are similar in function to HEGO sensor 30 shown in FIG. 1, and which may be located on each bank of a "V" type engine which incorporates multiple cylinder banks. These sensors each transmit signals indicative of the pre-catalyzed combustion products via signal lines 511 and 612 to the EEC 100, such that each sensor forms a feedback loop. In such an embodiment, the steps shown in FIGS. 3(*a–c*) are applied to each sensor individually. The feedback loop associated with each sensor is treated separately, and as such is subjected to its own modulation and subsequent determination of LAMBSE shift.

It will be appreciated by those skilled in the art that an embodiment of the present invention may incorporate the post-catalytic oxygen sensor 603 along with both of the pre-catalytic oxygen sensors 501 and 602.

It is to be understood that the specific mechanisms and techniques which have been described are merely illustrative of one application of the principles of the invention. Numerous modifications may be made to the methods and apparatus described without departing from the true spirit and scope of the invention.

What is claimed is:

1. A fuel controller for calculating an air/fuel composition for ignition in an internal combustion engine, the controller comprising, in combination:

means, responsive to an oxygen sensor, for calculating a quantity of fuel for said air/fuel composition, said oxygen sensor detecting the oxygen products of the ignited air/fuel composition;

means, responsive to said oxygen sensor, for detecting a bias in said oxygen sensor, said oxygen sensor being characterized by a total switching time comprising a first switching time for switching from a lean air/fuel composition to a rich air/fuel composition and a second switching time for switching from a rich air/fuel composition to a lean air/fuel composition, and further characterized by a difference between said first and said second switching times which is indicative of said bias; and means, responsive to said bias, for altering said calculated quantity of fuel comprising, first means for determining the total switching time of said sensor comprising means for operating said engine under a closed-loop form of control characterized by a limit-cycle frequency, means for detecting the limit-cycle frequency, and means for determining the total switching time as a function of the limit-cycle frequency;

second means, responsive to said first means, for determining the difference between said first and said second switching times comprising means for measuring the mean value of an air/fuel feedback signal over a predetermined time interval, said signal responsive to said oxygen sensor for altering said air/fuel composition, means for storing said mean value of said air/fuel feedback signal in a memory, means for modulating the engine air/fuel feedback signal at a predetermined amplitude and at a frequency substantially equal to said measured limit-cycle frequency, means for measuring the mean value of said modulated air/fuel feedback signal, and means for determining the difference between said modulated air/fuel feedback signal and said stored feedback signal, and using said difference to determine the difference between the first and the second switching times of said oxygen sensor; and third means responsive to said first means and to said second means for altering said calculated quantity of fuel.

2. In an internal combustion engine comprising, means for delivering an air/fuel composition to said engine, an oxygen sensor for detecting the oxygen content of the exhaust gases produced by said engine, and means, responsive to the oxygen content of combustion gases detected by said oxygen sensor, for calculating a quantity of fuel for said air/fuel composition, said oxygen sensor characterized by a first switching time for switching from a lean air/fuel composition to a rich air/fuel composition and a second switching time for switching from a rich air/fuel composition to a lean air/fuel composition, a method of determining the difference between the first and the second switching time of the oxygen sensor, the method comprising the steps of:

operating said engine under a closed-loop form of control, characterized by a limit-cycle frequency;

checking a plurality of engine operating parameters to determine if said engine is operating within a predetermined operating range, and if said engine is operating within said predetermined range then, measuring the limit-cycle frequency;

measuring the mean value of an air/fuel feedback signal over a predetermined time interval;

storing said mean value of said air/fuel feedback signal in a memory;

modulating the engine air/fuel feedback signal at a predetermined amplitude and at a frequency substantially equal to said measured limit-cycle frequency;

measuring the mean value of said modulated air/fuel feedback signal; and determining the difference between said modulated air/fuel feedback signal and said stored feedback signal, and using said difference to determine the difference between the first and the second switching times of said oxygen sensor.

3. The method as set forth in claim 2 wherein said difference is a function of the operational speed of said engine.

4. The method as set forth in claim 2 comprising the additional step of setting an oxygen sensor inoperative condition if said switching time difference exceeds a predetermined value.

5. A method of monitoring an oxygen sensor in an internal combustion engine comprising control means for delivering an air/fuel composition to said engine, said control means, characterized by a limit-cycle frequency, the method comprising the steps of:

periodically determining if said engine is operating within a predetermined operating range by, sensing the operational speed of said engine and the mass air flow rate into said engine, comparing said engine speed and said air flow rate against predetermined values to determine if said engine speed and said air flow rate are each within, respectively a predetermined engine speed range and a predetermined air flow rate range, and determining said engine to be operating within said predetermined operating range if said engine speed is within said predetermined engine speed range and said air flow rate is within said predetermined air flow rate range;

determining a total switching time, for an oxygen sensor which detects the oxygen content of the exhaust gases produced by said engine, the total switching time comprising a lean-to-rich switching time and a rich-to-lean switching time;

checking the total switching time against a first range and if the switching time is outside of said range, setting an oxygen sensor inoperative condition, otherwise determining the difference between said lean-to-rich switching time and rich-to-lean switching times; and checking the difference against a second range and if the difference is outside of said second range, setting an oxygen sensor inoperative condition.

6. The method as set forth in claim 5 wherein the predetermined limit-cycle frequency range is a function of said operating speed of said engine.

7. The method as set forth in claim 5 wherein the step of determining the difference between said first switching time and said second switching time comprises the steps of:

measuring the mean value of an air/fuel feedback signal over a predetermined time interval;

storing said mean value of said air/fuel feedback signal in a memory;

modulating the engine air/fuel feedback signal at a predetermined amplitude and at a frequency substantially equal to said measured limit-cycle frequency;

measuring the mean value of said modulated air/fuel feedback signal; and determining the difference between said modulated air/fuel feedback signal and said stored feedback signal, and using said difference to determine the difference between the first and the second switching times of said oxygen sensor.

8. The method as set forth in claim 5 comprising the additional step of repeating the aforesaid steps a predetermined number of times.

9. The method as set forth in claim 5 comprising the additional step of aborting the monitoring of the oxygen sensor if said engine is operating outside of said predetermined operating range.

10. The method as set forth in claim 9 comprising the additional step of periodically determining if said engine is operating within said predetermined operating range and reinitiating the monitoring of the oxygen sensor if said engine is operating within said predetermined operating range.

11. The method as set forth in claim 5 comprising the further steps of generating a compensation factor as a function of said switching time difference; and calculating said quantity of fuel for said air/fuel composition as a function of said compensation factor.

12. The method as set forth in claim 11 wherein the engine further comprises a catalytic converter and the oxygen sensor is positioned so as to be exposed to pre-catalyzed exhaust gases.

13. The method as set forth in claim 12 wherein the engine further comprises at least two exhaust pipes for transporting said exhaust gases produced by said engine to said catalytic converter, and a single post-catalytic exhaust pipe for transporting said exhaust gases from said catalytic converter, and wherein the engine further comprises an oxygen sensor corresponding to each of said exhaust pipes.

14. The method as set forth in claim 12 wherein the engine further comprises a post-catalytic oxygen sensor, said sensor placed so as to be exposed to post-catalyzed exhaust gases.

15. The method as set forth in claim 11 wherein the engine further comprises a plurality of cylinder banks and an oxygen sensor corresponding to each cylinder bank and wherein said oxygen sensor test is performed individually on each of said banks.

16. The method as set forth in claim 15 wherein the step of comparing said difference with a predetermined first switching time difference value utilizes a predetermined second switching time difference value in place of said predetermined first switching time difference value.

17. The method as set forth in claim 16 wherein the engine further comprises a post-catalytic feedback loop, and wherein the post-catalytic feedback loop is characterized by a dynamic correction range, and wherein the difference between said predetermined first switching time difference value and said predetermined second switching time difference value is a function of said dynamic correction range.

* * * * *